US009303937B2

(12) United States Patent
Acarreta

(10) Patent No.: US 9,303,937 B2
(45) Date of Patent: Apr. 5, 2016

(54) COUNTING DEVICE

(76) Inventor: Raul Delgado Acarreta, Tudela (ES)

( * ) Notice: Subject to any disclaimer, the term of this patent is extended or adjusted under 35 U.S.C. 154(b) by 104 days.

(21) Appl. No.: 14/371,259

(22) PCT Filed: Jan. 10, 2012

(86) PCT No.: PCT/ES2012/070014

§ 371 (c)(1),
(2), (4) Date: Dec. 9, 2014

(87) PCT Pub. No.: WO2013/104807

PCT Pub. Date: Jul. 18, 2013

(65) Prior Publication Data

US 2015/0113847 A1 Apr. 30, 2015

(51) Int. Cl.
*F41A 19/01* (2006.01)

(52) U.S. Cl.
CPC ..... *F41A 19/01* (2013.01)

(58) Field of Classification Search
CPC ..... F41A 19/01; F41A 9/62
USPC ..... 42/1.01, 1.02, 1.03, 1.04, 1.05, 84
See application file for complete search history.

(56) References Cited

U.S. PATENT DOCUMENTS 4,001,961 A * 1/1977 Johnson ..... F41A 19/01 324/94
5,005,307 A * 4/1991 Horne ..... F41A 9/62 42/1.02
5,142,805 A * 9/1992 Horne ..... F41A 19/01 42/1.02
5,406,730 A * 4/1995 Sayre ..... F41A 19/01 42/1.02
5,799,432 A * 9/1998 Wright, Sr. ..... F41A 9/62 42/1.02
2006/0096144 A1* 5/2006 Acarreta ..... F41A 19/01 42/1.01
2008/0016744 A1* 1/2008 Joannes ..... F41A 19/01 42/1.01
2008/0276517 A1* 11/2008 Acarreta ..... F41A 9/62 42/1.02
2008/0289485 A1* 11/2008 Quinn ..... F41A 19/01 89/1.1
2009/0211139 A1* 8/2009 Ufer ..... F41A 19/01 42/1.03
2009/0277065 A1* 11/2009 Clark ..... F41A 19/01 42/1.03
2010/0139141 A1* 6/2010 Pikielny ..... F41A 19/01 42/1.03
2010/0299985 A1* 12/2010 Acarreta ..... F41A 19/01 42/1.03
2011/0072703 A1* 3/2011 Ferrarini ..... F41A 19/01 42/1.01
2011/0252682 A1* 10/2011 Acarreta ..... F41A 9/62 42/1.02
2012/0011756 A1* 1/2012 Amarante ..... F41A 17/066 42/1.01
2012/0131828 A1* 5/2012 August ..... F41A 19/01 42/1.02
2012/0144711 A1* 6/2012 Glock ..... F41A 19/01 42/1.03
2012/0167423 A1* 7/2012 Kindt ..... F41A 9/62 42/1.02
2013/0219762 A1* 8/2013 Acarreta ..... F41C 27/00 42/1.03
2014/0203913 A1* 7/2014 Danzy ..... F41A 35/00 340/10.1
2014/0230296 A1* 8/2014 Kuparinen ..... F41A 17/063 42/1.01
2015/0113847 A1* 4/2015 Acarreta ..... F41A 19/01 42/1.01
2015/0226505 A1* 8/2015 Amit ..... F41A 19/01 42/1.02

FOREIGN PATENT DOCUMENTS

WO 2011144768 A1 11/2011

* cited by examiner

*Primary Examiner* — Joshua Freeman
(74) *Attorney, Agent, or Firm* — Hayes Soloway, P.C.

(57) ABSTRACT

Counting device designed to determine the number of shots and cartridges in a weapon, which comprises an activator sensor (11) that supplies an activation signal to a processor (12) in response to a mechanical impulse; the processor (12) in turn supplies a counting-initiation signal to a counting sensor (13) that supplies at least two counting signals offset by a predetermined period of time to the processor (12).

13 Claims, 1 Drawing Sheet

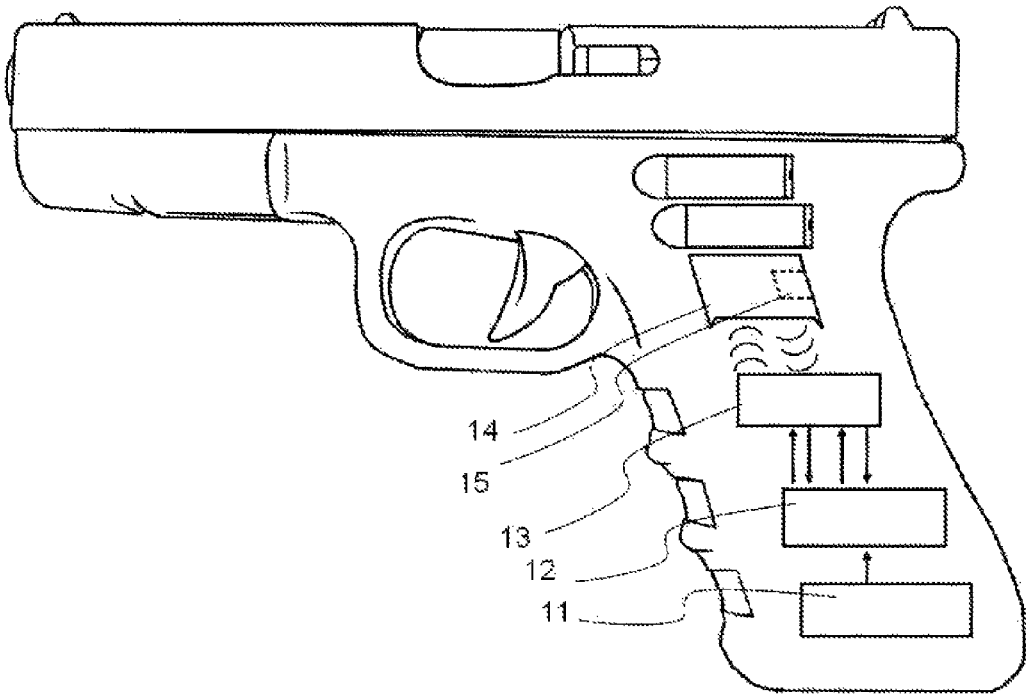
14
15
13
12
11

COUNTING DEVICE

FIELD OF THE INVENTION

The present invention relates to a counting device which determines the number of shots and cartridges of a weapon.

BACKGROUND OF THE INVENTION

At present, there are different patents disclosing devices that measure shots in weapons, such as patent document ES2292842(T3), which describes a shot counting device based on counting the number of shells expelled out of a firearm chamber through an expulsion window, and showing on a display screen the number of shots that therefore remain available in the loader mounted on the weapon. This shot counter has the limitation of only showing the information regarding the number of actual shots, as it is possible to lose cartridges through the chamber when it is mounted, or because there is a discharge without detonation following the firing of defective cartridges, measuring only the number of undetonated shells and cartridges that are expelled by the chamber. This patent moreover does not possess a method to ratify whether or not a shot was fired.

SUMMARY

The present invention seeks to resolve or reduce one or more of the drawbacks set out above by means of a counting device as defined in the claims.

The counting device provides counting of the number of shots fired by the weapon and the number of cartridges stored in a weapon's magazine, in such a way that it unifies in the same counting device two different values supplying information to the weapon user on the type of shots fired, cartridges stored in a magazine that can be mounted on the weapon, frequency of shooting, remaining useful life of weapon parts such as the barrel, etc.

The counting device comprises an activator sensor, a processor and a counting sensor, wherein the activator sensor sends an activation signal to the processor, which supplies a start signal to the counting sensor which carries out at least two measurements of the number of cartridges stored in the weapon's magazine. The counting sensor carries out two measurements of the magnetic or electromagnetic field emitted by the magnetic or electromagnetic field emitter respectively, both measurements being offset by a time interval to determine the number of cartridges, these measurements of the number of cartridges taken by the counting sensor are supplied to the processor where it is evaluated whether or not a shot has been fired within the operating cycle of the weapon, providing information regarding the number of shots and cartridges stored in the magazine. The period of time is that in which the number of cartridges has decreased by at least one unit during the weapon's shooting cycle.

The processor is of the type such as a computer, microprocessor, microcontroller, FPGA, DSP or ASIC.

This processor can be in constant communication with the activator sensor.

The time interval between measurements can be predetermined or obtained by means of auto-calibration. This time interval can vary depending on the weapon employed. By way of an example, this time interval is in the order of milliseconds for automatic firearms and conventional semi-automatic weapons.

In a simplified manner, the functioning of the device of the invention is based on the fact that once the detonation has occurred or any type of vibration, it is detected by an activator sensor which triggers a counting sensor, which determines the number of cartridges housed in the magazine before and after the next cartridge is replenished in the chamber, and observing the reduction in the number of cartridges in this short time interval, it determines whether or not a shot was fired, and the exact quantity of cartridges present in the magazine.

One aspect of the counting device is derived from the use of an activator sensor which makes it possible to avoid the consumption of energy entailed by having the counting sensor always in operation, i.e., measuring, and that establishes a time origin for the actuation of the counting sensor.

Yet another aspect of the counting device is that it supplies information to the user about the number of cartridges in the magazine at any given time, simultaneously, meaning that it provides a single device that unifies both functions, the counting of shots and the number of cartridges.

Another aspect of the loading device is that it supplies very reliable information to the user, as it avoids errors in the counting of shots, as if a weapon receives a blow or series of repetitive blows these are not counted as a shot, thanks to the fact that the counting device is based on observing whether there has been a change in the cartridges of the magazine in a short time interval to check whether a cartridge has been expended, and consequently, whether a shot has been fired.

Another aspect of the counting device is that it allows various information to be supplied to the user regarding the ammunition, such as informing for example whether a shot has been fired, the firing frequency of a weapon, real expenditure of ammunition, the status of the ammunition in the magazine at any given time, and even informs the user of the need to maintain parts and clean the weapon.

BRIEF DESCRIPTION OF THE DRAWINGS

A more detailed explanation of the device according to embodiments of the invention is provided in the following description based on the attached FIGURE wherein:

FIG. 1 shows an outline of a block diagram of the counting device.

DESCRIPTION OF A MODE OF EMBODIMENT

In respect of FIG. 1, an embodiment of the counting device is illustrated which determines the number of cartridges stored in a magazine of the same weapon during the period of time in which the expulsion window of the weapon's chamber remains open after a shot has been fired using the firearm, specifically, once the detonation has occurred, it determines the number of cartridges stored in the magazine before and after the chamber has been replenished with the first cartridge stored in the magazine.

Once the firearm fires a shot, the chamber is opened and closed in a predetermined period of time which is a function of the type of weapon and the cartridge that is spent. This period of time is practically impossible to reproduce by any other type of actuation on the weapon.

The counting device comprises an activator sensor, a processor and a counting sensor. The kinematic chain of the shot comprises the following stages: once the shot has been fired, the detonation gases of the cartridge push, for example, the weapon's slider to the end of the track on which the slider runs, which extracts the shell from the chamber by means of an extractor claw; once the chamber is open and without a shell in it, for example, the loader spring, pushes with the help of a follower in the loader the first cartridge stored in the loader towards its position within the chamber; subsequently, the slider, due to the recovery spring, collects the cartridge and introduces it into the chamber, decreasing, in this process, the number of cartridges housed in the loader.

Within a characteristic shooting pattern it is possible to observe in its variations the different parts into which the kinematic chain of the shot is divided and its duration in time, a mechanical impulse like a vibration produced by the detonation of the cartridge present in the chamber in the first peak and which awakens the activator sensor 11 of the piezoelectric sensor type, being what sends an activation signal to a data processor 12, which in turns sends a counting-initiation signal to the counting sensor 13.

Once the activation signal has been received by the processor 12, a measurement action begins of the time relative to the period of time during which the weapon's chamber remains open.

As mentioned previously, said time period is characteristic of the type of weapon and the cartridge that is shot. Consequently, different patterns associated to the kinematic chain of different weapons are stored in the processor 12.

In accordance with the selected pattern, the processor 12 is prepared to receive two counting signals within the period of time during which the weapon's chamber remains open, both counting signals being supplied from the counting sensor 13.

The first counting signal relates to the number of cartridges present in the loader. The signal supplied is a function of the position of a magnet 15 installable on the follower 14 of the loader, for example.

This first measurement made by the counting sensor 13 is taken before the cartridge that follows the one that has been fired is introduced into the weapon's chamber.

Once the processor 12 has received this reading, the same processor prepares to receive a second counting signal once the shot has concluded. The counting sensor 13 measures again the number of cartridges left in the loader after a predetermined period. If a shot has really been fired, the next cartridge has been pushed up into the weapon's chamber, and therefore there will be one cartridge less in the loader meaning that the processor 12 will count one shot.

If the weapon has received a blow or vibration not corresponding to a shot, then the number of cartridges in the loader in the predetermined time interval will not have varied and, therefore, the processor 12 will not count one shot.

Once both counting signals have been received, the processor 12 calculates whether they have been received within the predetermined period of time, and whether there is a minimum time difference between the counting signals, depending on the selected pattern.

The processor 12 compares the two counting signals to each other if the abovementioned requirements are positively fulfilled. When the comparison of both signals is made, the processor 12 verifies the existence of a difference between both counting signals, if there is a difference between both signals of the processor 12 it emits a signal of a shot being fired and decreases by one unit the number of cartridges stored in the magazine, loader, which is saved in a memory.

When the processor 12 determines that a shot has been fired, it supplies an information signal to a display which shows the number of cartridges left in the magazine at that time. If the weapon has received a blow or vibration and no shot has been fired, the number of cartridges in the loader will not have varied, and therefore, it will not be counted as a shot.

The counting device is electrically supplied by a power source such as a battery, rechargeable battery, etc.

To reduce power consumption the rest of the counting device is powered exclusively when the activator sensor 11 detects a mechanical impulse with a predetermined value.

The activator sensor 11 is of the inertia sensor type, a piezoelectric sensor or accelerometer, which is activated by means of a blow or strong impulse that the weapon receives, such as a shot.

The counting sensor 13 is of the type of sensor that measures the forces of a magnetic or electromagnetic field, which in the case of measuring magnetic forces could be a Hall sensor and in the case of a sensor for electromagnetic signals is like an optical sensor. The electrical output signals of the counting sensor 13 are proportional to the magnitude of the magnetic or electromagnetic field detected by an element 15 capable of emitting a magnetic or electromagnetic field, which in the case of magnetic fields may be a permanent or induced magnet and in the case of emitting electromagnetic fields may be a LED.

The counting sensor 13 as in the case of element 15 may be situated in any part of the magazine and the grip, in such a way that said relative position between both elements makes it possible for the counting sensor 13 to detect at least one position of the cartridges of the weapon. Therefore, the element 15 capable of emitting a magnetic or electromagnetic field may be situated on the follower 14, on the spring, and therefore on the body of the loader it may be inside or outside the casing thereof, on the grip of the weapon or any combination thereof.

The counting device includes a data input/output interface connected to the processor 12 of the radio interface type in such a way that the processor 12 can communicate with a reader apparatus that also includes an input/output interface of the radio interface type. The reader apparatus can supply data to the processor 12 such as weapon patterns and can recover data from the counting device such as shots carried out by same.

The invention claimed is:

1. Counting device for determining a number of shots and cartridges of a weapon comprising an activator sensor which supplies an activation signal to a processor in response to a mechanical impulse; the processor in turn supplies a counting-initiation signal to a counting sensor which supplies at least two counting signals offset by a predetermined period of time to the processor which is adapted to evaluate whether said counting signals have been received within the period of time in which the number of cartridges has decreased by at least one unit during one shooting cycle of the weapon.

2. Device according to claim 1, wherein the counting sensor supplies at least two counting signals associated to the number of cartridges stored in a magazine.

3. Device according to claim 1, wherein the processor on a basis of the counting signals received is adapted to evaluate whether or not a shot has been fired, supplying information regarding the number of shots fired and cartridges stored in the magazine.

4. Device according to claim 1, wherein the activator sensor is an inertia sensor.

5. Device according to claim 4, wherein the inertia sensor is of the piezoelectric sensor or accelerometer type.

6. Device according to claim 1, wherein the processor is of the type that includes a computer, microprocessor, microcontroller, FPGA, DSP or ASIC.

7. Device according to claim 1, wherein the counting sensor is adapted to measure the forces of magnetic fields or electromagnetic signals.

8. Device according to claim 7, wherein the counting sensor is a Hall sensor.

9. Device according to claim 7, wherein the counting sensor is an optical sensor.

10. Device according to claim 1, wherein the device comprises an element that is adapted to emit magnetic or electromagnetic fields.

11. Device according to claim 10, wherein the element that is adapted to emit magnetic fields is a permanent or induced magnet.

12. Device according to claim 10, wherein the element that is adapted to emit electromagnetic fields is a LED.

13. Device according to claim 1, wherein the predetermined period of time between counting signals is predetermined or obtained through auto-calibration.

* * * * *